US005402353A

United States Patent [19]

Laplante et al.

[11] Patent Number: 5,402,353

[45] Date of Patent: Mar. 28, 1995

[54] METHOD AND APPARATUS FOR PRODUCING A PRIMARY ROLL OF MATERIAL

[75] Inventors: Benoit Laplante, Sherbrooke; Daniel Charland, St-Elie d'Orford, both of Canada

[73] Assignee: HTRC Automation Inc., Bromptonville, Canada

[21] Appl. No.: 69,942

[22] Filed: May 28, 1993

[51] Int. Cl.[6] ..... B65H 63/08

[52] U.S. Cl. ..... 364/471; 242/534.2; 242/541.6

[58] Field of Search ..... 242/57, 66, 75–75.53, 242/67.1 R–67.5, 36, 39, 534.2, 541.5, 541.6, 541.4, 541.7; 364/469–473

[56] References Cited

U.S. PATENT DOCUMENTS

| | | | |
|---|---|---|---|
| 3,792,820 | 2/1974 | Lucas | 242/66 |
| 3,910,516 | 10/1975 | Hoffacker et al. . | |
| 4,519,039 | 5/1985 | Surana et al. | 364/469 |
| 4,631,682 | 12/1986 | Ng et al. | 364/471 |
| 4,715,550 | 12/1987 | Erni et al. | 242/39 |
| 4,811,915 | 3/1989 | Smith | 242/66 |
| 4,883,233 | 11/1989 | Saukkonen et al. | 242/66 |
| 4,913,366 | 4/1990 | Andou | 242/57 |
| 5,042,736 | 8/1991 | Nomura et al. | 242/57 |
| 5,086,984 | 2/1992 | Turek et al. . | |

*Primary Examiner*—Paul P. Gordon

*Assistant Examiner*—Steven R. Garland

*Attorney, Agent, or Firm*—Merchant & Gould, Smith, Edell, Welter & Schmidt

[57] ABSTRACT

The method is for producing a first primary roll having a predetermined lateral surface defined by a diameter $D_f$. The primary roll is made of material wound around a spindle. The material is used to produce smaller secondary rolls of material. The method comprises steps of (a) calculating a portion $S_f$ of the lateral surface, which is covered by the spindle; (b) calculating a portion $S_i$ of the lateral surface, Which represents material needed to produce the smaller secondary rolls of material; (c) calculating a compression factor K1 which is derived from a compression rate K of a previous second primary roll used to produce previous secondary rolls with respect to the previous secondary rolls; (d) calculating $D_f$ where:

$$D_f = \sqrt{(4(S_f + (S_i K1)))/\pi}$$

(e) winding up material around the spindle to produce the first primary roll until a diameter of the first primary roll reaches said diameter $D_f$; whereby loss of material is reduced by taking into account compression factor K1 which varies with respect to time. An apparatus to perform the present method is also provided.

10 Claims, 3 Drawing Sheets

METHOD AND APPARATUS FOR PRODUCING A PRIMARY ROLL OF MATERIAL

FIELD OF THE INVENTION

The present invention is concerned with a method and an apparatus for producing a primary roll having a predetermined lateral surface defined by a Diameter $D_f$. The primary roll is made of material wound around a spindle. The material is used to produce smaller secondary rolls of material. More specifically, the present invention can be used in the paper industry.

BACKGROUND OF THE INVENTION

Known in the art, there is the U.S. Pat. No. 4,519,039 of Bhupendra S. SURANA et al, granted on May 21, 1985 in which there is described a programmable controller including coil diameter calculator, strip speed derivation and inertia compensation. The controller is associated with a reel system for the generation in normalized digital form of a coil diameter of the reel instantaneously to allow initial calibration between successive coil winding and unwinding operations and automatic generation of a current reference for reel motor drive control.

Also known in the art, there is the U.S. Pat. No. 4,631,682 of David T. NG et al, granted on Dec. 23, 1986, in which there is described a control system which provides automatic control of winder deceleration and stopping to a preset sheet length, or preset roll diameter. The system utilizes a closed loop control of drive deceleration and automatic compensation for layers slabbed off following a sheetbreak.

Also known in the art, there is the U.S. Pat. No. 5,086,984 Of Douglas E. TUREK et al, granted on Feb. 11, 1992, in which there is described a method of predicting final yarn package diameter during winding of yarn onto the package. The yarn is to be wound onto the package for a known period of time to obtain the final yarn package diameter. The method comprises the steps of: measuring the time for the package to grow to a known diameter, and predicting yarn package diameter using a predetermined correlation.

Also known in the art, there are the U.S. Pat. No. 4,913,366; 4,883,233; 4,811,915; 3,910,516; and 3,792,820 which describe different apparatuses and methods relating to the production of a roll of material.

In the paper industry, big primary roll are used to produce smaller secondary rolls which will be sold to clients. When successive primary rolls are used to produce secondary rolls, the amount of paper wound around each primary roll with identical diameter will not produce the same amount of material on secondary rolls because the compression rate of the paper wound around each primary roll with respect to material wound around their respective secondary rolls varies from time to time because the operating conditions of the machines used to produce secondary rolls from a primary roll are not exactly the same from time to time.

Accordingly, to solve this problem, it is known to wound around each primary roll an additional amount of paper to be sure that there will be enough paper for the secondary rolls that should be produced.

One problem with this is that a certain amount of paper is lost at the end of each primary roll when it is unrolled.

None of the above patents provides a method or an apparatus that takes into account the fact that the compression rate at which the paper is wound around a primary roll with respect to secondary rolls is not constant.

It is an object of the present invention to provide a method and an apparatus for estimating with more precision the final diameter of the primary roll so that the loss of material when said primary roll is used to produce secondary rolls is reduced to minimum.

SUMMARY OF THE INVENTION

According to the present invention, there is provided a method for producing a first primary roll having a predetermined lateral surface defined by a diameter $D_f$, said primary roll being made of material wound around a spindle, said material being used to produce smaller secondary rolls of material, said method comprising steps of:

(a) calculating a portion $S_f$ of said lateral surface, which is covered by said spindle;

(b) calculating a portion $S_i$ of said lateral surface, which represents material needed to produce said smaller secondary rolls of material;

(c) calculating a compression factor K1 which is derived from a compression rate K of a previous second primary roll used to produce previous secondary rolls with respect to said previous secondary rolls;

(d) calculating $D_f$ where:

$$D_f = \sqrt{(4(S_f + (S_i K1)))/\pi}$$

(e) winding up material around said spindle to produce said first primary roll until a diameter of said first primary roll reaches said diameter $D_f$;

whereby loss of material is reduced by taking into account said compression factor K1 which varies with respect to time.

Also according to the present invention, there is provided an apparatus for producing a first primary roll having a predetermined lateral surface defined by a lateral diameter $D_f$, said primary roll being made of material wound around a spindle, said material being used to produce smaller secondary rolls of material, said apparatus comprising:

means for calculating a portion $S_f$ of said lateral surface, which is covered by said spindle;

means for calculating a portion $S_i$ of said lateral surface, which represents material needed to produce said smaller secondary rolls of material;

means for calculating a compression factor K1 which is derived from a compression rate K of a previous second primary roll used to produce previous secondary rolls with respect to said previous secondary rolls;

(d) means for calculating $D_f$ where:

$$D_f = \sqrt{(4(S_f + (S_i K1)))/\pi}$$

(e) means for winding up material around said spindle to produce said first primary roll until a diameter of said first primary roll reaches said diameter $D_f$;

whereby loss of material is reduced by taking into account said compression factor K1 which varies with respect to time.

The objects, advantages and other features of the present invention will become more apparent upon reading of the following non restrictive description of a preferred embodiment thereof given for purpose of exemplification only with reference to the accompanying drawings.

DETAILED DESCRIPTION OF THE DRAWINGS

Figure 1:
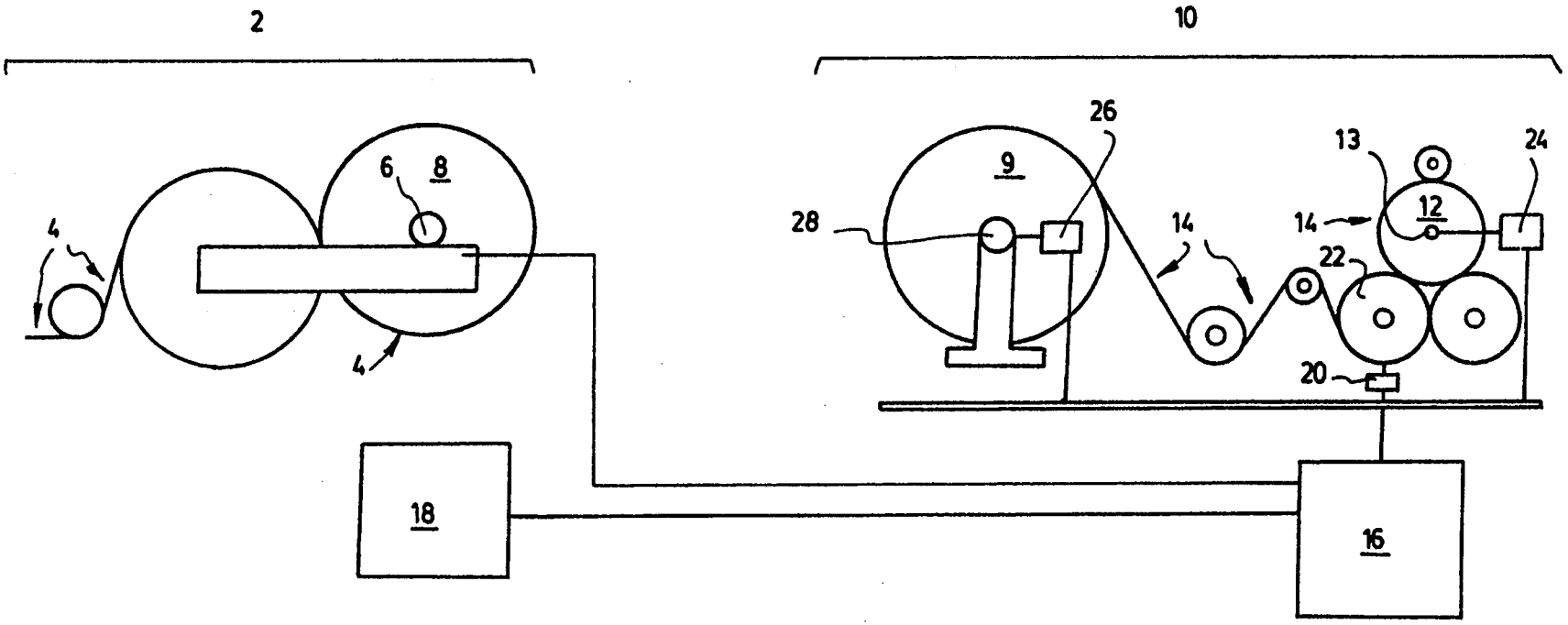
FIG. 1 is a schematic diagram illustrating schematically how a primary roll is produced, and how a secondary roll is produced from a primary roll.

Referring now to FIG. 1, there is shown working station 2 where a sheet of paper 4 is wound around a metal spindle 6 to produce primary roll 8. Also, there is shown working station 10 where primary roll 9 is unrolled to produce secondary roll 12. From one primary roll 9, several smaller secondary rolls 12 are produced to be delivered to clients. The final diameter $D_f$ of the primary roll 9 depends directly on the final diameter of the secondary rolls 12 to be delivered to the clients.

It has been found that for an identical combination of secondary rolls to be produced from a primary roll, the diameter of successive primary rolls will not be the same. This is caused by the variation of volumetric reduction of the paper sheet 14 due to mechanical work at the working station 10 when the paper sheet 14 is unrolled from the primary roll 9 and wound around spindle 13 to produce secondary roll 12.

Also, when primary roll 8 is produced, paper sheet 4 can be torn or a portion of paper sheet 4 can have an unacceptable quality. All these factors have to be taken into consideration so that the primary roll 8 has a sufficient amount of paper to produce predetermined secondary rolls to be delivered to clients.

The working stations 2 and 10 are provided with several equipments which comprise a computer 16, a terminal 18 disposed nearby an operator, an optical detector 20 for detecting the number of turns made by drum 22, an optical detector 24 for detecting the number of turns made by secondary roll 12, and another optical detector 26 for detecting the number of turns made by spindle 28.

Figure 2:
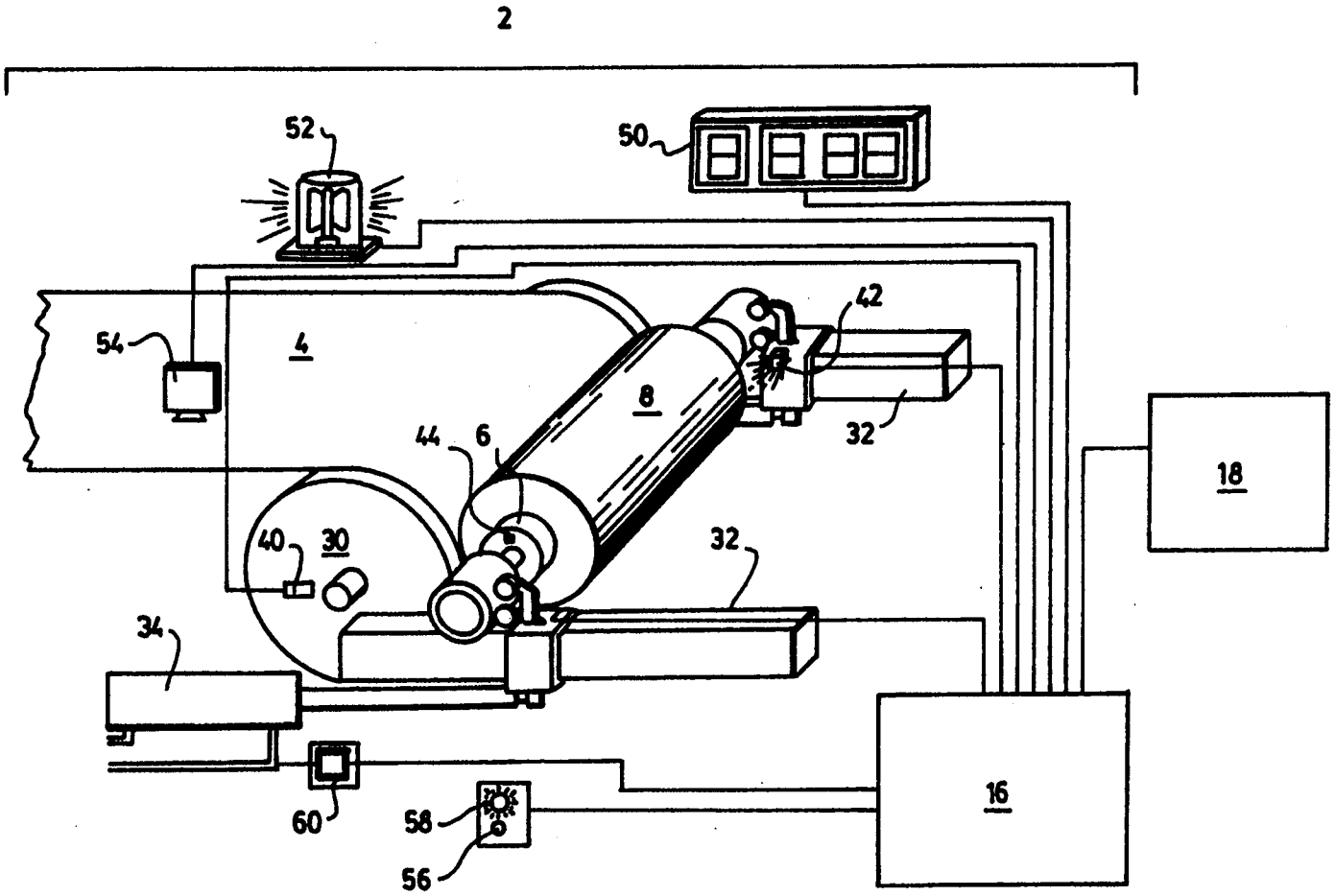
FIG. 2 is a schematic diagram illustrating with more details a working station shown in FIG. 1.

Referring now to FIG. 2, there is shown with more details working station 2. Paper sheet 4 coming from a paper machine (not shown) is moved around drum 30 to be wound around spindle 6. Spindle 6 is supported by means of rails 32. A constant pressure is applied on each side of the spindle 6 of primary roll 8 by means of cylinders 34. Only one cylinder 34 is shown in this figure, but it is understood that each side of spindle 6 is subjected to a pressure applied by a cylinder. Paper sheet 4 is wound around spindle 6 until the diameter of primary roll S reaches a predetermined value.

The present system is capable of measuring the diameter of primary roll 8 in real time. Several known methods can be used for measuring this diameter. According to working station 2, shown in FIG. 2, the diameter of primary roll 8 is calculated from pulses received from detector 40 and detectors 42. Only one detector 42 is shown in FIG. 2, but the other side of spindle 6 is also provided with a detector. Detector 40 generates a pulse during each turn of drum 30 and detectors 42 generate a pulse during each turn of spindle 6. A reflecting sticker 44 is stuck at each end of spindle 6 and is used to reflect an optical ray generated by detectors 42. When one detector 42 receives a reflection from its corresponding sticker 44, it generates instantaneously an electric pulse which is sent to computer 16. Only one of detectors 42 is used at the time. The second detector 42 is used as a back-up. Computer 16 measures with precision the period of time between pulses generated by detectors 40 and 42 and calculates in real time the radius D of primary roll 8.

$$D=[(T_f D_e)/T_e],$$

where D is the diameter of primary roll 8, $T_f$ is the period of time measured between two pulses generated by detector 42, $D_e$ is the diameter of drum 30, and $T_e$ is the period of time measured between two pulses generated by detector 40.

Also shown in this FIG. 2, there are a display 50 showing the period of time remaining before the actual diameter of primary roll 8 reaches a predetermined diameter, an alarm 52, a detector 54 detecting when paper sheet 4 is torn up, a button 56 by which the operator can also indicate to computer 16 that paper sheet 4 is torn up, another button 58 by which the operator can indicate to computer 16 that quality of paper is not acceptable, and a pressure detector 60 by which computer is informed of pressure applied by cylinders 34.

Referring now to FIGS. 1 and 2, it is understood that diameters of secondary roll 12 and primary roll 9 of working station 10 can be determined in real time by optical means similar to the ones shown in FIG. 2.

The apparatus for producing first primary roll 8 having a predetermined lateral surface defined by lateral diameter $D_f$ is shown in FIGS. 1 and 2. The primary roll 8 is made of material wound around spindle 6. The material is used to produce smaller secondary rolls 12 of material. The apparatus comprises means for calculating a portion $S_f$ of the lateral surface of primary roll, which is covered by its spindle. This means for calculating is performed by computer 16 and the calculation is done with respect to parameters entered by the operator by means of terminal 18.

The apparatus also comprises means for calculating a portion $S_p$ of the lateral surface, which represents remaining unusable material wound around the spindle of primary roll. Again, this means for calculating is performed by computer 16 with respect to parameters entered by the operator.

The apparatus also comprises means for calculating a portion $S_a$ of the lateral surface, which represents an error margin determined by the operator. Again, this error margin corresponds to parameters entered in computer 16 by the operator.

The apparatus also comprises means for calculating a portion $S_i$ of the lateral surface which represents material needed to produce several smaller secondary rolls of material. This portion $S_i$ is calculated from parameters entered by the operator in computer 16.

Also, the apparatus comprises means for calculating a compression factor K1 which is derived from a compression rate K where K=[(sum of lateral surfaces of material of previous primary roll 9 used to produce previous secondary rolls 12)/(sum of lateral surfaces of material of said previous secondary rolls 12)]. This means for calculating is performed by computer 16 by means of equipments at working station 10.

The apparatus also comprises means for calculating $D_f$ where:

$$D_f = \sqrt{(4(S_f + S_p + S_a + (S_i K1)))/\pi}$$

This means for calculating $D_f$ is performed by computer 16.

The apparatus also comprises means for winding up material around spindle 6 to produce primary roll 8 until its diameter reaches diameter $D_f$. This means for winding up is situated at working station 2. By means of the present apparatus, the loss of material is reduced by taking into account compression factor K1 which varies with respect to time.

Also, the apparatus preferably comprises means for calculating at least another compression rate K of at least another primary roll with respect to previous secondary rolls, and means for calculating an average value of the compression rates K so that the compression factor K1 be derived from the average value. Again, the above-mentioned means for calculating are performed by the computer 16 when successive primary rolls 9 are unrolled to produce secondary rolls 12 at working station 10.

In operation, first, when no compression rate K has been calculated, the operator determines, in an empirical manner, the diameter of primary roll 8 in function of the number and the size of secondary rolls to be delivered to clients. He also adds a security margin. Once primary roll 8 has a diameter which reaches the predetermined diameter, the operator transfers primary roll 8 from working station 2 to working station 10 where said primary roll becomes primary roll 9.

Then, paper sheet 14 is engaged around metal spindle 13 so that primary roll 9 be unrolled to produce a first secondary roll 12. When first secondary roll 12 reaches a desired diameter, it is removed from working station 10, and paper sheet 14 is disposed around another spindle 13 to produce another secondary roll 12. This operation is repeated until primary roll 9 has not enough paper to produce another secondary roll 12. Then, the remaining amount of paper around spindle 28 is lost.

But, as primary roll 9 is unrolled to produce secondary rolls, a compression factor K1 is derived from a compression rate K where K=[(sum of lateral surfaces of material of primary roll 9 used to produce secondary rolls 12)/(sum of lateral surfaces of material of secondary rolls 12)]. The value of the compression factor K1 can be equal to the compression rate K or it can correspond to an average value of compression rates K calculated during successive unwinding of primary rolls 9.

Figure 3:
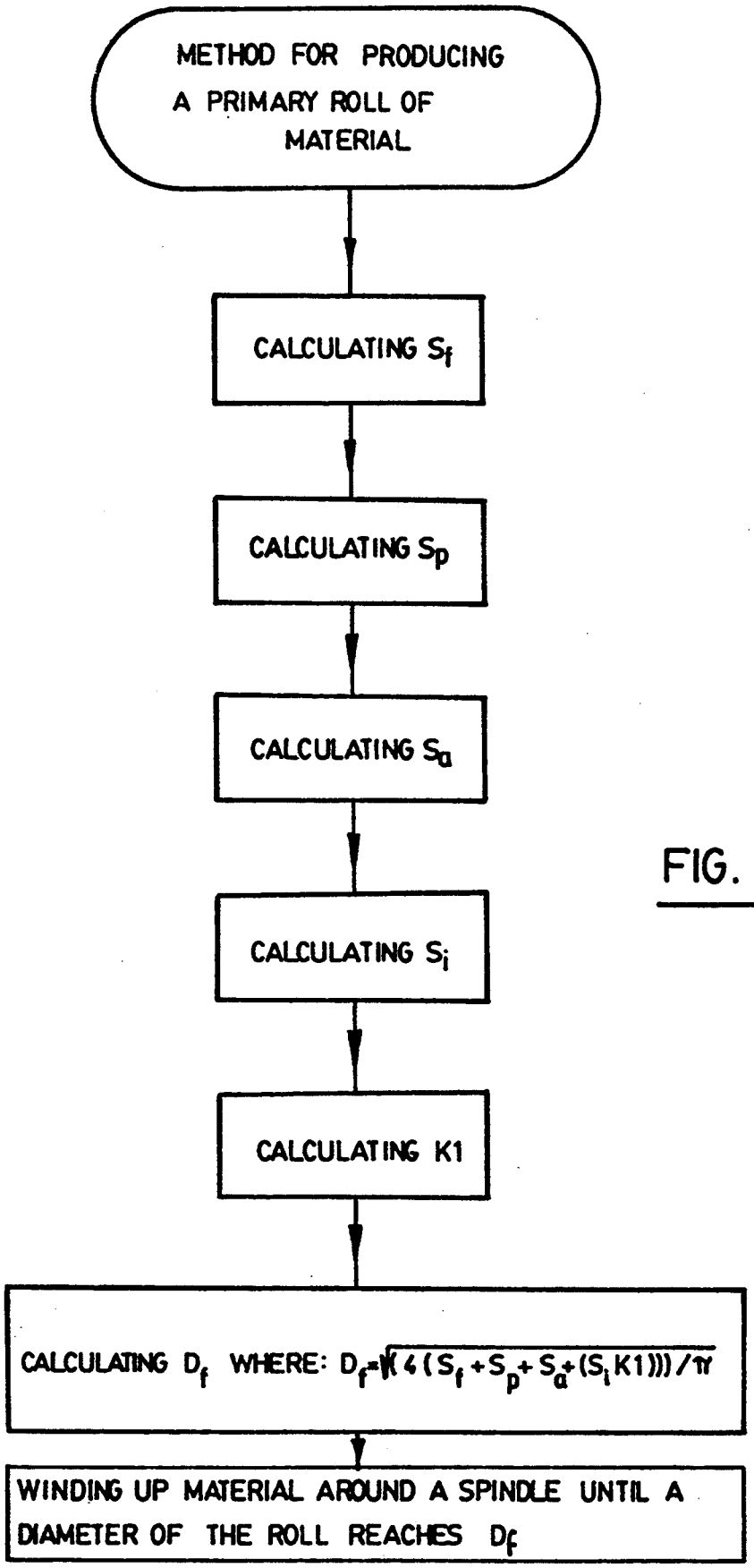
FIG. 3 is a flow chart diagram illustrating the method for producing a primary roll in accordance with the present invention.

When a value of compression factor K1 has been obtained, then it is possible to perform the method according to the present invention for producing the next primary roll 8 of material according to the flow chart shown in FIG. 3. The method is for producing a primary roll 8 having a predetermined lateral surface defined by a diameter $D_f$. The material will be used to produce smaller secondary rolls 12 of material. The method comprises steps of calculating a portion $S_f$ of the lateral surface, which is covered by spindle 6; calculating a portion $S_p$ of the lateral surface, which represent remaining unusable material wound around spindle 6, such portion $S_p$ being determined by the operator; calculating a portion $S_a$ of the lateral surface, which represents an error margin determined by the operator; calculating a portion $S_i$ of the lateral surface, which represents material needed to produce smaller secondary rolls 12 of material; calculating the compression factor K1 which is derived from the compression factor K defined earlier; calculating $$D_f = \sqrt{(4(S_f + S_p + S_a + (S_i K1)))/\pi}$$

and winding up material around spindle 6 to produce first primary roll 8 until its diameter reaches diameter $D_f$, whereby loss of material is reduced by taking into account pressure factor K1 which varies with respect to time.

The compression factor K1 is calculated in real time each time that primary roll 9 is unrolled at working station 10. The measure of diameter of primary roll 9 and secondary roll 12 can be done by means of different optical means, mechanical means and electrical means. We will now describe one manner to determine the diameters of rolls 9 and 12. By means of pulse generator 20 having a resolution of several pulses by turn, attached to drum 22, and by means of another pulse generator 26 having a resolution of one pulse by turn, attached to spindle 28, it is possible to calculate in real time the diameter of primary roll 9 at working station 10.

Computer 16 calculates diameter $D_p$ of primary roll 9 by means of the following equation:

$$D_p=[(PPT_1\ D_t)/RT_1]$$

where $RT_1$ is the resolution of pulse generator 20 in pulses by turn, $D_t$ is the diameter of drum 22, $PPT_1$ is the number of pulses produced by pulse generator 20 for each pulse generated by pulse generator 26. Calculation of the diameter of secondary roll 12 is done in a similar manner by using pulse generators 20 and 24. When secondary roll 12 has been completed, computer 16 calculates lateral surface of rolls 9 and 12 by means of the following equations:

$$S_p=[((\pi(D_p \text{ at the beginning})^2)/4)-((\pi(D_p \text{ at the stop})^2)/4)]$$

$$S_s=[((\pi(D_s \text{ at the stop})^2)4)-((\pi(D_s \text{ at the beginning})^2)/4)]$$

where $S_p$ is the lateral surface of material of primary roll 9, used for producing secondary roll 12; $D_p$ are diameters at the beginning and at the stop of primary roll 9 when winding of secondary roll 12 begins and ends; $S_s$ is the lateral surface of material of secondary roll 12; and $D_s$ are diameters at the beginning and at the stop of secondary roll 12.

If three secondary rolls are produced from one primary roll 9, then:

$$K1=K=[(S_{p1}+S_{p2}+S_{p3})/(S_{s1}+S_{s2}+S_{s3})].$$

It has to be noted that only the lateral surfaces transferred from primary roll 9 to secondary rolls 12 are used in the above-mentioned calculation. Thus, $S_{p1}$ is the lateral surface removed from primary roll 9 during the winding of secondary roll 12, which has been used for producing $S_{s1}$ of secondary roll 12.

The number and the size of secondary rolls to be produced from primary roll 9 are entered by the operator in computer 16 by means of terminal 18. Then, it is possible to calculate in real time $D_f$ of the next primary roll 8 at working station 2 by taking into consideration the compression factor K1 calculated by computer 16. The calculation of $D_f$ can be done according to the equation mentioned earlier.

In order to better understand the method according to the present invention, we will now describe an example with possible parameters. First, we have to calculate a first value of K1 when primary roll 9 is unrolled to produce smaller secondary rolls 12. In this example, four secondary rolls are produced. Each of the secondary rolls has a spindle having a diameter of 0.100 m, and has a final diameter of 1.00 m.

For the production of the first secondary roll, $D_{s1}$ and $D_{p1}$ are 0.100 m and 2.117m at the beginning, and 1.00 m and 1.864 m at the stop. Then, computer 16 calculates $S_{s1}$ which is:

$$[((\pi(1.000\ \text{m})^2)4)-((\pi(0.1000\ \text{m})^2/4)]=0.7775\ \text{m}^2.$$

We also calculate $S_{p1}$ which is:

$$[((\pi(2.117\ \text{m})^2)4)-((\pi(1.862\ \text{m})^2/4)]=0.7969\ \text{m}^2.$$

For the production of the second secondary roll, $D_{s2}$ and $D_{p2}$ are 0.100 m and 1.862 m at the beginning and 1.00 m and 1.566 m at the stop. Then, we calculate $S_{s2}$ which is:

$$[((\pi(1.000\ \text{m})^2)4)-((\pi(0.100\ \text{m})^2/4)]=0.7775\ \text{m}^2.$$

We can also calculate $S_{p2}$ which is:

$$[((\pi(1.862\ \text{m})^2)4)-((\pi(1.566\ \text{m})^2/4)]=0.7969\ \text{m}^2.$$

For the production of the third secondary roll, $D_{s3}$ and $D_{p3}$ are 0.100 m and 1.566 m at the beginning, and 1.00 m and 1.199 m at the stop we can now calculate $S_{s3}$ and $S_{p3}$ with the equations mentioned above and we found that $S_{s3}=0.7775\ \text{m}^2$ and $S_{p3}=0.7969\ \text{m}^2$.

For the production of the fourth and last secondary roll, $D_{s4}$ and $D_{p4}$ are 0.100 m and 1.199 m at the beginning, and are 1.000 m and 0.650 m at the stop. By using the equations mentioned above, we found that $S_{s4}=0.7775\ \text{m}^2$ and $S_{p4}=0.7969\ \text{m}^2$.

We now calculate K which is in the present case K1.

$$K=[(0.7969\ \text{m}^2+0.7969\ \text{m}^2+0.7969\ \text{m}^2+0.7969\ \text{m}^2)/(0.7775\ \text{m}^2+0.7775\ \text{m}^2+0.7775\ \text{m}^2+0.7775\ \text{m}^2)]=1.025.$$

We are now ready to evaluate the final diameter $D_f$ of the next primary roll 8. First, the operator entered means of the terminal 18 a new order for producing a primary roll 8 at the working station 2, which will have enough paper to produce three smaller secondary rolls, each of the secondary rolls having a spindle diameter of 0.100 m and a final diameter of 1.2 m.

The spindle 6 mounted at the working station 2 has around it useless paper having a thickness of 0.025 m. Accordingly, a quantity of paper equivalent to this useless paper has to be added to obtain enough paper for producing the three secondary rolls.

The following parameters are entered by the operator at the terminal: diameter of the spindle 6 of primary roll 8, which is 0.600 m; thickness of the useless paper present around the spindle 6, which is 0.025 m; final diameters of three secondary rolls to be produced from this primary roll, each final diameter of the secondary rolls being 1.200 m, diameter spindle of secondary rolls, which is 0.100 m; and a security margin determined by the operator, which is 0.020 m. Also, it has be noted that the value of K1 is in the memory of the computer and has a value of 1.025.

$$[(\pi(\text{diameter of the spindle})^2)/4],$$

$$[(\pi(0.600)^2)/4]=0.283\ \text{m}^2.$$

Then, we calculate $S_p$ which represents the useless paper having a thickness of 0.025 m from the surface of the spindle. It is known that the spindle diameter is 0.600 m, and the external diameter of the paper loss is:

$$[(0.025\ \text{m}\times 2)+0.600\ \text{m}]=0.650\ \text{m}.$$

$S_p$ can now be calculated, which is:

$$[((\pi(\text{external diameter of useless paper})^2)/4)-((\pi(\text{internal diameter of useless paper})^2)/4)],$$

$$[((\pi(0.650\ \text{m})^2)/4)-((\pi(0.600\ \text{m})^2)/4)]=0.049\ \text{m}^2.$$

We now calculate the surface of paper relating to the error margin. As the error margin is 0.010 m, we can evaluate that the internal diameter of the error margin is 0.0650 m and its external diameter is 0.670 m. The surface relating to the error margin S is:

$$[((\pi(\text{external diameter of the paper relating to the error margin})^2)/4)-((\pi(\text{internal diameter of the paper relating to the error margin})^2)/4)],$$

$$[((\pi(0.670\ \text{m})^2)/4)-((\pi(0.650\ \text{m})^2)/4)]=0.021\ \text{m}^2.$$

We have new to calculate the surface $S_i$ of paper relating to the production of three secondary rolls, each of the secondary rolls having a final diameter of 1.200 m and a spindle diameter of 0.100 m. The surface $S_{bs}$ of one secondary roll is:

$$[((\pi((\text{external diameter of the roll})^2/4)-((\pi(\text{internal diameter of the roll})^2)/4)],$$

$$[((\pi(1.200\ \text{m})^2)/4)-((\pi(0.100\ \text{m})^2)/4)]=2.246\ \text{m}^2.$$

Consequently, the surface $S_i$ of three secondary rolls is $(2.246\ \text{m}^2\times 3)=6.739\ \text{m}^2$.

We now calculate the final diameter of the next primary roll, which is:

$$D_f=\sqrt{(4(S_f+S_a+S_p+(S_i K1)))/\pi}$$

$$D_f=\sqrt{(4(0.283\ \text{m}^2+0.021\ \text{m}^2+0.049\ \text{m}^2+(3.369\ \text{m}^2\times 1.025)))/\pi}$$

$$D_f=2.201\ \text{m}$$

Computer 16 will now monitor in real time the winding of the next primary roll S at working station 2 and will stop the winding when the diameter of primary roll 8 will reach the value of $D_f$.

Although the invention has been described above in detail in the framework of a preferred embodiment, it should be understood that the scope of the present invention is to be determined by the appended claims.

The embodiments of the invention in which an exclusive property or privilege is claimed are defined as follows:

1. Method for producing a first primary roll having a predetermined lateral surface defined by a diameter $D_f$, said primary roll being made of material wound around a spindle, said material being used to produce smaller secondary rolls of material, said method comprising steps of:

(a) calculating a portion $S_f$ of said lateral surface, which is covered by said spindle;

(b) calculating a portion $S_i$ of said lateral surface, which represents material needed to produce said smaller secondary rolls of material;

(c) calculating a time varying compression factor K1 which is derived from a compression rate K of a previous second primary roll used to produce previous secondary rolls with respect to said previous secondary rolls;

(d) calculating $D_f$ where:

$$D_f = \sqrt{(4(S_f + (S_iK1)))/\pi}$$

(e) winding up material around said spindle to produce said first primary roll until a diameter of said first primary roll reaches said diameter $D_f$;

whereby loss of material is reduced by taking into account said compression factor K1 which varies with respect to time.

2. Method according to claim 1, wherein said compression rate K=((sum of lateral surfaces of material of said previous second primary roll used to produce said previous secondary roll)/(sum of lateral surfaces of material of said previous secondary rolls)).

3. Method according to claim 2, wherein step (c) further comprises steps of:

(i) calculating at least another compression rate K of at least another previous primary roll with respect to other previous secondary rolls; and (ii) calculating an average value of said compression rates K so that said compression factor K1 is derived from said average value.

4. Method for producing a first primary roll having a predetermined lateral surface defined by a diameter $D_f$, said primary roll being made of material wound around a spindle, said material being used to produce smaller secondary rolls of material, said method comprising steps of:

(a) calculating a portion $S_f$ of said lateral surface, which is covered by said spindle;

(b) calculating a portion $S_p$ of said lateral surface, which represents remaining unusable material wound around said spindle;

(c) calculating a portion $S_a$ of said lateral surface, which represents an error margin determined by an operator;

(d) calculating a portion $S_i$ of said lateral surface, which represents material needed to produce said smaller secondary toils of material;

(e) calculating a time varying compression factor K1 which is derived from a compression factor K where K=((sum of lateral surfaces of material of a previous second primary roll used to produce previous secondary rolls)/(sum of lateral surfaces of material of said previous secondary rolls));

(f) calculating $D_f$ where:

$$D_f = \sqrt{(4(S_f + S_p + S_a + (S_iK1)))/\pi}$$

(g) winding up material around said spindle to produce said first primary roll until a diameter of said first primary roll reaches said diameter $D_f$;

whereby loss of material is reduced by taking into account said compression factor K1 which varies with respect to time.

5. Method according to claim 4, wherein step (e) further comprises steps of:

(i) calculating at least another compression rate K of at least another previous primary roll with respect to other previous secondary rolls; and (ii) calculating an average value of said compression rates K so that said compression factor K1 is derived from said average value.

6. Apparatus for producing a first primary roll having a predetermined lateral surface defined by a lateral diameter $D_f$, said primary roll being made of material wound around a spindle, said material being used to produce smaller secondary rolls of material, said apparatus comprising:

means for calculating a portion $S_f$ of said lateral surface, which is covered by said spindle;

means for calculating a portion $S_i$ of said lateral surface, which represents material needed to produce said smaller secondary rolls of material;

means for calculating a time varying compression factor K1 which is derived from a compression rate K of a previous second primary roll used to produce previous secondary rolls with respect to said previous secondary rolls;

(d) means for calculating $D_f$ where:

$$D_f = \sqrt{(4(S_f + (S_iK1)))/\pi}$$

(e) means for winding up material around said spindle to produce said first primary roll until a diameter of said first primary roll reaches said diameter $D_f$;

whereby loss of material is reduced by taking into account said compression factor K1 which varies with respect to time.

7. Apparatus according to claim 6, wherein said compression rate K=((sum of lateral surfaces of material of said previous second primary roll used to produce said previous secondary roll)/(sum of lateral surfaces of material of said previous secondary rolls)).

8. Apparatus according to claim 7, further comprising:

means for calculating at least another compression rate K of at least another previous primary roll with respect to the previous secondary rolls; and means for calculating an average value of said compression rates K so that said compression factor K1 is derived from said average value.

9. Apparatus for producing a first primary roll having a predetermined lateral surface defined by a lateral diameter $D_f$, Said primary roll being made of material wound around a spindle, said material being used to produce smaller secondary rolls of material, said apparatus comprising:

means for calculating a portion $S_f$ of said lateral surface, which is covered by said spindle;

means for calculating a portion $S_p$ of said lateral surface, which represents remaining unusable material wound around said spindle;

means for calculating a portion $S_a$ of said lateral surface, which represents an error margin determined by an operator;

means for calculating a portion $S_i$ of said lateral surface, which represents material needed to produce said smaller secondary rolls of material;

means for calculating a time varying compression factor K1 which is derived from a compression rate K where K=((sum of lateral surfaces of material of a previous second primary roll used to produce previous secondary rolls)/(sum of lateral surfaces of material of said previous secondary rolls));

means for calculating $D_f$ where:

$$D_f = \sqrt{(4(S_f + S_p + S_a + (S_i K1)))/\pi}$$

means for winding up material around said spindle to produce said first primary roll until a diameter of said first primary roll reaches said diameter $D_f$;

whereby loss of material is reduced by taking into account said compression factor K1 which varies with respect to time.

10. Apparatus according to claim 9, further comprising:

means for calculating at least another compression rate K of at least another previous primary roll with respect to other previous secondary rolls; and means for calculating an average value of said compression rates K so that said compression factor K1 is derived from said average value.

* * * * *